US006393356B1

(12) United States Patent
Clement et al.

(10) Patent No.: US 6,393,356 B1
(45) Date of Patent: May 21, 2002

(54) METHOD AND ARRANGEMENT FOR CONTROLLING A DRIVE UNIT OF A VEHICLE

(75) Inventors: Albrecht Clement, Vaihingen; Manfred Homeyer; Frank Plagge, both of Markgroeningen; Torsten Bauer, Vaihingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 115 days.

(21) Appl. No.: 09/612,358

(22) Filed: Jul. 7, 2000

(30) Foreign Application Priority Data

Jul. 10, 1999 (DE) ..... 199 32 309

(51) Int. Cl.[7] ..... F02D 41/14

(52) U.S. Cl. ..... 701/102; 701/110; 701/108; 701/101; 123/350

(58) Field of Search ..... 701/102, 110, 701/101, 108, 109; 123/350, 492, 399; 477/110, 120, 115, 112

(56) References Cited

U.S. PATENT DOCUMENTS 5,484,351 A 1/1996 Zhang et al. ..... 477/113
5,496,227 A * 3/1996 Minowa et al. ..... 477/110
5,692,472 A 12/1997 Bederna et al. ..... 123/350
5,857,163 A * 1/1999 Trombley et al. ..... 701/101
6,076,500 A * 6/2000 Clement et al. ..... 123/339.16
6,223,721 B1 * 5/2001 Bauer et al. ..... 123/399
6,251,044 B1 * 6/2001 Streib ..... 123/350
6,285,946 B1 * 9/2001 Steinmann ..... 701/110

FOREIGN PATENT DOCUMENTS

DE 43 44 137 A1 * 6/1995 ..... F01N/3/20

* cited by examiner

*Primary Examiner*—John Kwon
*Assistant Examiner*—Hieu T. Vo
(74) *Attorney, Agent, or Firm*—Walter Ottesen

(57) ABSTRACT

The invention is directed to a method and an arrangement for controlling a drive unit of a vehicle wherein maximum permissible value is pregiven for monitoring purposes for the output quantity for the drive unit. In this value, requirement values of at least one consumer and/or one ancillary function are included. The inclusion only takes place when the at least one consumer and/or the ancillary function is actually active. To determine whether the consumer and/or ancillary function is active, two pieces of data as to the activation state are evaluated, which pieces of data are independent of each other.

11 Claims, 4 Drawing Sheets

METHOD AND ARRANGEMENT FOR CONTROLLING A DRIVE UNIT OF A VEHICLE

BACKGROUND OF THE INVENTION

A method and an arrangement for controlling a drive unit of a vehicle are disclosed, for example, in U.S. Pat. No. 5,692,472. In this patent, a quantity, which represents an output quantity of an internal combustion engine, is compared to a maximum permissible value pregiven for this quantity. This is done for monitoring purposes in the context of the control of the drive unit of a motor vehicle. Fault reaction measures are initiated when the quantity exceeds the pregiven permissible value. Examples for the output quantity of the drive unit are the power of the drive unit or a torque thereof, for example, the indicated torque, the output torque, but also the position of the throttle flap, et cetera. In one embodiment, the computer, which executes the control of the drive unit, includes at least two program levels separated from each other. The described comparison for monitoring purposes is computed in the second program level. The first program level is for programs which compute the functions provided for the control of the drive unit.

For determining the maximum permissible value, in general, and when no drive command of the operator is present, the largest occurring value of the output quantity is permitted in order to ensure an unlimited drivability. The output quantity can be adjusted by the idle control. Consumers such as a climate control compressor, a torque converter, et cetera operate greatly on the output quantity of the drive unit primarily for vehicles having small engines, low rolling resistance or low inner friction. Accordingly, relatively large permissible values are to be pregiven with the view to these consumers and the drivability in these applications.

The solution of the conflict between a monitoring as precise as possible (that is, in the case of a fault, the earliest possible response of the monitoring system) and the largest possible availability is primarily dependent upon the exact determination of the permissible value for the output quantity of the drive unit. This is especially the case when functions and/or components, which are driven by the drive unit, are provided whose activation changes the output quantity independently of the driver command, that is, especially when the output quantity must be increased. This is considered in the formation of the permissible value.

SUMMARY OF THE INVENTION

It is an object of the invention to provide a method and an arrangement for determining the maximum permissible value for the output quantity of a drive unit of a motor vehicle which solves the above-mentioned dichotomy satisfactorily.

The method of the invention for controlling a drive unit of a vehicle, the method including the steps of: forming a desired value for an output quantity of the drive unit at least on the basis of a driver command; controlling the drive unit to adjust the desired value; pregiving a maximum permissible value for the output quantity and reducing the output quantity when the output quantity exceeds the maximum permissible value; increasing the output quantity when at least one consumer or an ancillary function is activated independently of the driver command; increasing the maximum permissible value when the consumer or the ancillary function is actually switched on; and, deriving the actual switch-on on the basis of at least two quantities which represent the activation status of the consumer or ancillary function.

U.S. patent application Ser. No. 09/297,863, filed May 10, 1999, discloses inputting a maximum permissible value to which a desired value is to be limited when the output quantity exceeds the maximum permissible value. The desired value is for the output quantity of the drive unit of a motor vehicle. Here too, the above-described dichotomy occurs. Such a limiting function is, preferably, computed in the first program level.

U.S. Pat. No. 5,484,351 discloses to compute the requirement as to torque of a torque converter of an automatic transmission and of the compressor of a climate control system on the basis of operating variables. In a comparable manner, the requirement as to torque of other consumers such as of a power steering, of a generator, et cetera can be determined in dependence upon the quantities indicating the engine load. Furthermore, status signals are available which indicate the activation status of such consumers, for example, a force engagement in the transmission, an active climate control system, et cetera.

The redundant signals indicate the status of the at least one consumer and/or of the at least one function. With these redundant signals, the initially mentioned dichotomy is satisfactorily resolved. Especially the operational reliability as well as the availability of the control of the drive unit are adequately considered because the requirement of these components (consumer and/or function) on the output quantity is only then computed in the permissible value when the components are actually active. This leads to a more precise improved input of the permissible value for the output quantity of the drive unit.

It is a special advantage that the increase of the permissible value for an active component is only undertaken when an actually active component is recognized as being plausible based on the at least redundant status data as to the activity of the component. These status data are provided on various paths. If the at least two redundant pieces of data contradict each other, then the maximum permissible value for this malfunction is pregiven in the context of an emergency operation with the view to ensuring operational reliability of the drive unit control, as a rule, the maximum permissible value is pregiven to a lower value.

A special advantage is that consumers (such as a climate control compressor, a torque converter of an automatic transmission unit, a power steering unit, et cetera) as well as functions (such as a catalytic converter heating function), which increase the output quantity, are considered.

BRIEF DESCRIPTION OF THE DRAWING

The invention will now be described with reference to the drawings wherein.

DESCRIPTION OF THE PREFERRED EMBODIMENTS OF THE INVENTION

Figure 1:
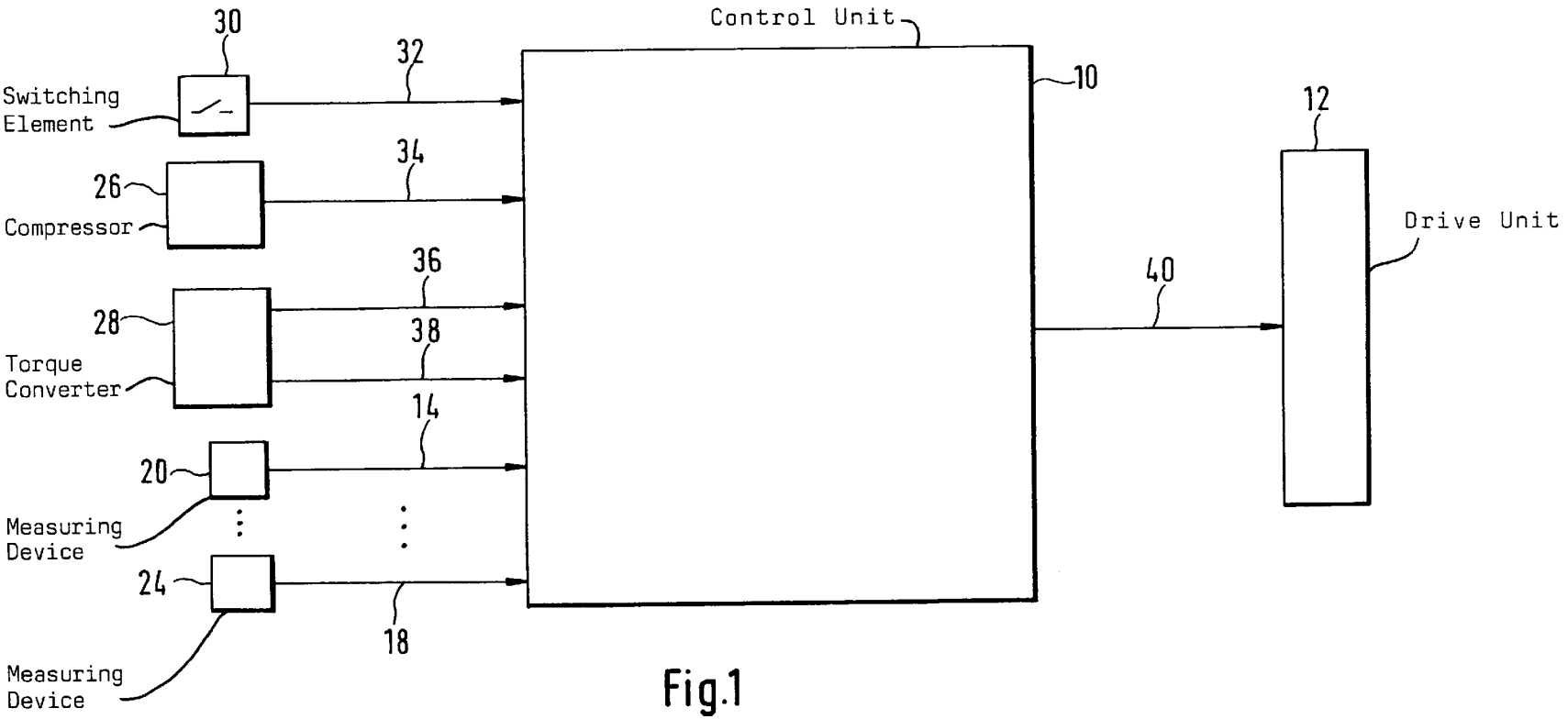
FIG. 1 shows a block circuit diagram of a control arrangement for controlling the drive unit of a motor vehicle; and, FIGS. 2 to 4 show respective flowcharts of preferred embodiments of the method according to the invention for determining the maximum permissible value of an output quantity of the drive unit.

FIG. 1 shows a control apparatus 10 for controlling a drive unit 12 wherein the control apparatus 10 includes at least one computer including a memory wherein the programs are stored. These programs function to control the drive unit 12. For executing these programs, operating variables of the drive unit and/or of the vehicle are supplied from corresponding measuring devices 20 to 24 to the computer via input lines 14 to 18, respectively. These operating variables are evaluated by the computer and are considered in the formation of the at least one actuating signal for the drive unit 12. Such operating variables include, for example, the engine rpm, engine temperature, accelerator pedal position, et cetera. In addition to the output, the drive unit drives additional components in accordance with the driver input such as the torque converter of an automatic transmission, components of a power steering system, a generator, a climate control compressor, et cetera. If these components are active, they consume a part of the output quantity, which is generated by the drive unit 12, such as the power, the torque, et cetera. This requirement placed on the output quantity of the drive unit by the components can, for example, be determined on the basis of the procedure known from the state of the art.

In the embodiment shown in FIG. 1, components are shown by way of example and include a climate control compressor 26 and a torque converter 28. Each of these components includes a control unit which controls the particular component. Furthermore, a switching element 30 is provided via which the climate control compressor is activated and whose signal therefore indicates the activation status.

With the view to the procedure described hereinafter, the status of these components is determined in two different ways and is transmitted in two different ways to the control unit 10. Accordingly, an input line 32 leads from the switching element 30 to the control unit 10 on which a signal B_KO is transmitted, which describes the status of the switching element 30 and therefore the status of the compressor. Furthermore, a variable is transmitted via an input line 34 from the compressor 26 which corresponds to the loading of the drive unit by the compressor. This can be a corresponding load signal or torque signal, for example, it can even represent the pressure in the high pressure region of the climate control system. Correspondingly, a status signal B_FS, which indicates the force engagement in the drive train, and a signal, which represents the load of the drive unit from the torque converter, are transmitted from the torque converter via the line 36. The last signal can, for example, be the torque requirement signal known from the state of the art.

In the preferred embodiment, the status signals are transmitted on separate lines; whereas, the load signals are transmitted via a bus system internal to the motor vehicle such as CAN. In one embodiment, the latter can take place as pulsewidth modulated signals in the context of separate lines.

Furthermore, and in the context of the control of the drive unit especially in connection with internal combustion engines, ancillary functions are carried out in some operating states (such as a heating function of the catalytic converter), which increase the output quantity of the drive unit independently of the driver command and therefore should be considered in the determination of the maximum permissible output quantity value. The status of these ancillary functions is also redundantly detected in that two items of data which are independent of each other, are formed with respect to the activity of the ancillary function. In the example of the catalytic converter heating function, these data are formed internally, namely, a corresponding mark B_KHZ, which is set when the conditions are given for the execution of the catalytic converter heating function and which is reset when these conditions are no longer satisfied, as well as a further condition, which indicates the activation of this function, when the steady-state desired rpm of the idle controller is greater than a pregiven rpm threshold.

The input quantities supplied to the control apparatus 10 are converted into at least one actuating quantity by the programs running in the computer. This actuating quantity controls the at least one operating variable of the drive unit 12 in the sense of the input quantities via the at least one output in line 40 of the control apparatus 10. In the preferred embodiment, a desired torque is determined from the input quantities, especially the accelerator pedal position and engine rpm. This desired torque is converted into drive signals for controlling: the throttle flap position, the ignition angle and/or the fuel metering, et cetera of an internal combustion engine. The torque of the engine approaches the pregiven desired value. In this context, the above-described catalytic converter heating function is applied and/or the above-described requirement values of the at least one consumer as well as the loss torques of the drive unit are considered. The loss torque is known from the state of the art.

In the preferred embodiment, a subdivision of the programs into at least two levels is provided. Programs are assigned to the first level which execute the control functions including the desired value limiting shown in the above-mentioned state of the art initially described herein; whereas, monitoring programs are assigned to the second level which are likewise described in the state of the art initially mentioned herein.

In the determination of the maximum permissible value of the output quantity, as mentioned above, the requirement values of the at least one component (consumer and/or ancillary function) on the output quantity are to be considered when determining the maximum permissible value. This takes place when the at least one component is actually active. If the data with respect to the activity of such a component would be formed only on the basis of one individual signal, then the danger would be present that the consumer would be given as active, and the maximum permissible value is increased accordingly without it being ensured that the corresponding component is actually activated. The accuracy of the monitoring is therefore limited in some applications. Accordingly, at least two signals which are independent of each other, are to be made available to the control apparatus, for external signal sources along two different paths. The status of the component is derived from these signals. These at least two signal values are compared to each other with respect to plausibility. For a clear status, the required value of the corresponding component on the output quantity of the drive unit is considered in the formation of the maximum permissible value.

In a preferred embodiment, and with respect to the compressor of the climate control system, the switching signal B_KO is supplied as a status signal to the control apparatus 10 as a double insurance of the activation status by means of a bidirectional or unidirectional line. In addition, a signal, which defines the load of the drive unit caused by the compressor, is supplied via the bus system, which is internal to the motor vehicle, or is supplied by means of a pulsewidth modulated signal. The signal can, for example, be a pressure signal in the high pressure region of the climate control system or it can be a torque requirement value. The detection of the switched-on climate control compressor is then ensured via two separate paths. If one of the signals indicates a non-activated climate control compressor, the requirement value of the compressor is set to the value 0. A pressure equalization takes place within the climate control system if the climate control compressor is defective. The value 0 is transmitted as the load data. In this way, it is ensured that the requirement value of the climate control compressor is only included in computations when the compressor is actually switched on. This is only assumed when at least two signals, which are independent of each other, indicate an active component.

The same procedure is followed when considering the requirement value of the torque converter of the automatic transmission. Here too, a driving stage switching signal is transmitted via a line; that is, the data is transmitted as to whether a driving stage is engaged or not. In addition, the loss quantity of the converter is transmitted via the bus system or a pulsewidth modulated signal. Preferably, the loss torque of the converter is transmitted which, for example, is determined on the basis of the procedure described in the initially mentioned state of the art. In this case too, the double insurance is guaranteed. The requirement value is included in the permissible value of the output quantity only when an actual activation of the component is determined based on both signals. If, for example, the load data of the converter is 0, then the requirement value, which is taken into the permissible value, is also 0.

One proceeds in the same manner with ancillary functions, which increase the output quantity, for example, the catalytic converter heating function. In order to heat the catalytic converter, the desired rpm of the idle control is increased in specific operating ranges. In this way, the output quantities of the drive unit to be permitted are increased, for example, the permissible torque. This increase of the permissible value of the output quantity takes place only when the function is actually active. A double insurance of the detection of the activation is achieved via the steady-state desired rpm, which is checked with reference to a pregiven rpm threshold, and via a bit which is set when the function is active. When the rpm threshold is exceeded, the function is assumed to be active. Here too, the requirement value is only computed into the permissible value when an actual activation of the function is detected based on both pieces of data.

The at least one requirement value is considered for the permissible value in two different ways depending upon the embodiment. In the first embodiment, a minimum selection is carried out between the then computed requirement value and a maximum requirement value for the individual component and/or the summation of the requirement values of the components; on the other hand, one offset value is computed for the selected components or a separate offset value is computed for each component.

With respect to the first method, the smaller value is preferably selected from the actual requirement values (loss torque) of the components (for example, their sums) with or without drag torque and from the rpm-dependent maximum requirement value (loss torque) of all consumers (for example, the sum of individual maximum values) inclusive of the adaptation parts of the requirement values. This smaller value is superposed as an offset value on the maximum permissible value which, for example, is formed on the basis of the accelerator pedal position and the rpm. The computation of the requirement values is known from the above-mentioned state of the art. The maximum requirement value for each component is determined in dependence upon rpm via a predetermined characteristic line. In the summation formation, only the portions of the active component are included (also in the formation of the maximum value).

In the second procedure, an offset value is determined for the permissible value of the output quantity for the selected components such as climate control compressor and torque converter and/or the catalytic converter heating function. This determination is made only when the particular function and/or the particular consumer is actually active. The offset value is a fixed value depending upon the embodiment and is determined on the basis of an rpm-dependent characteristic line or in the context of a characteristic field as a function of the supplied load data and the rpm. The offset value is then so predetermined that it covers also the maximum possible adaptation part of the particular component.

Figure 2:
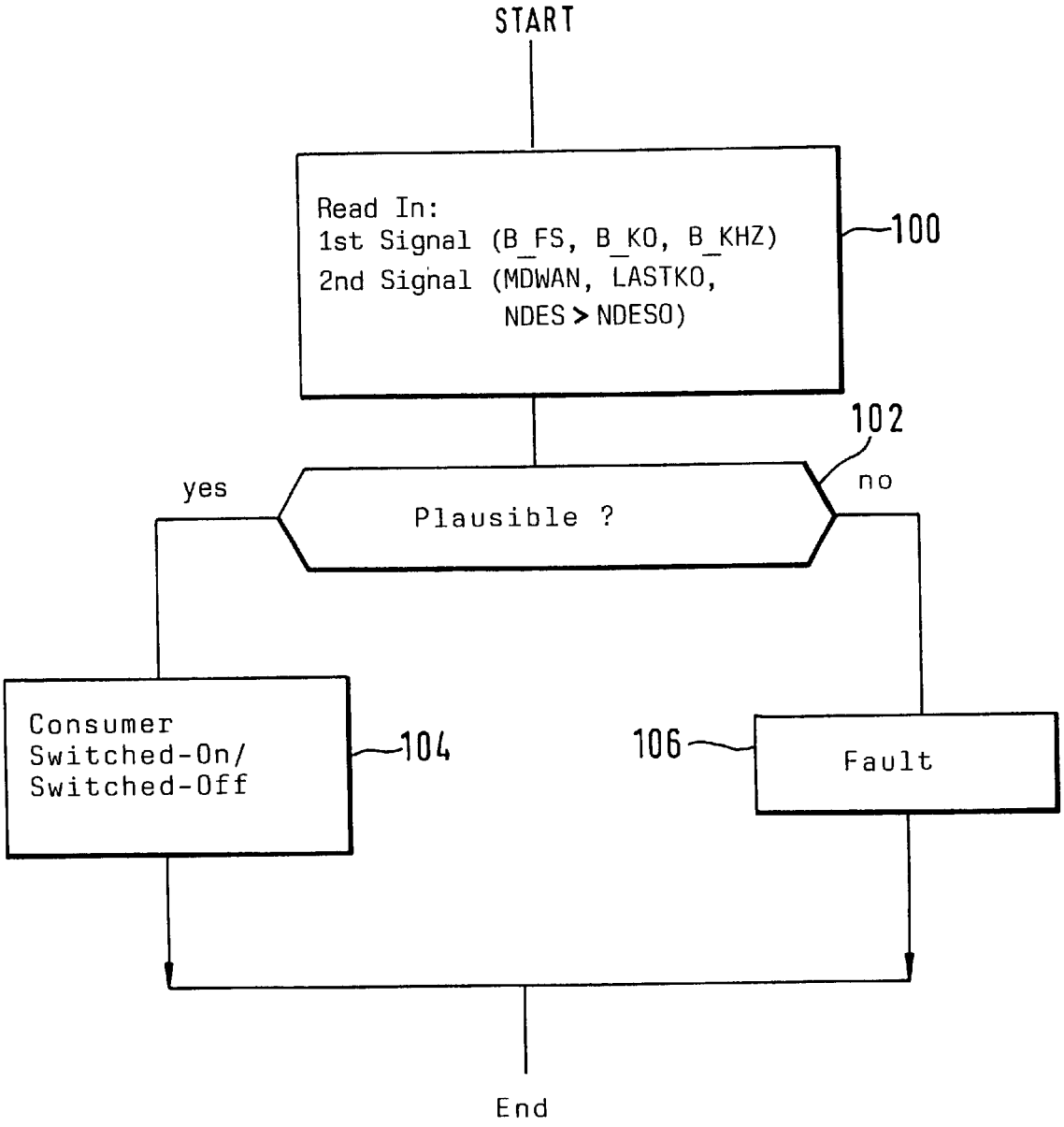
Figure 3:
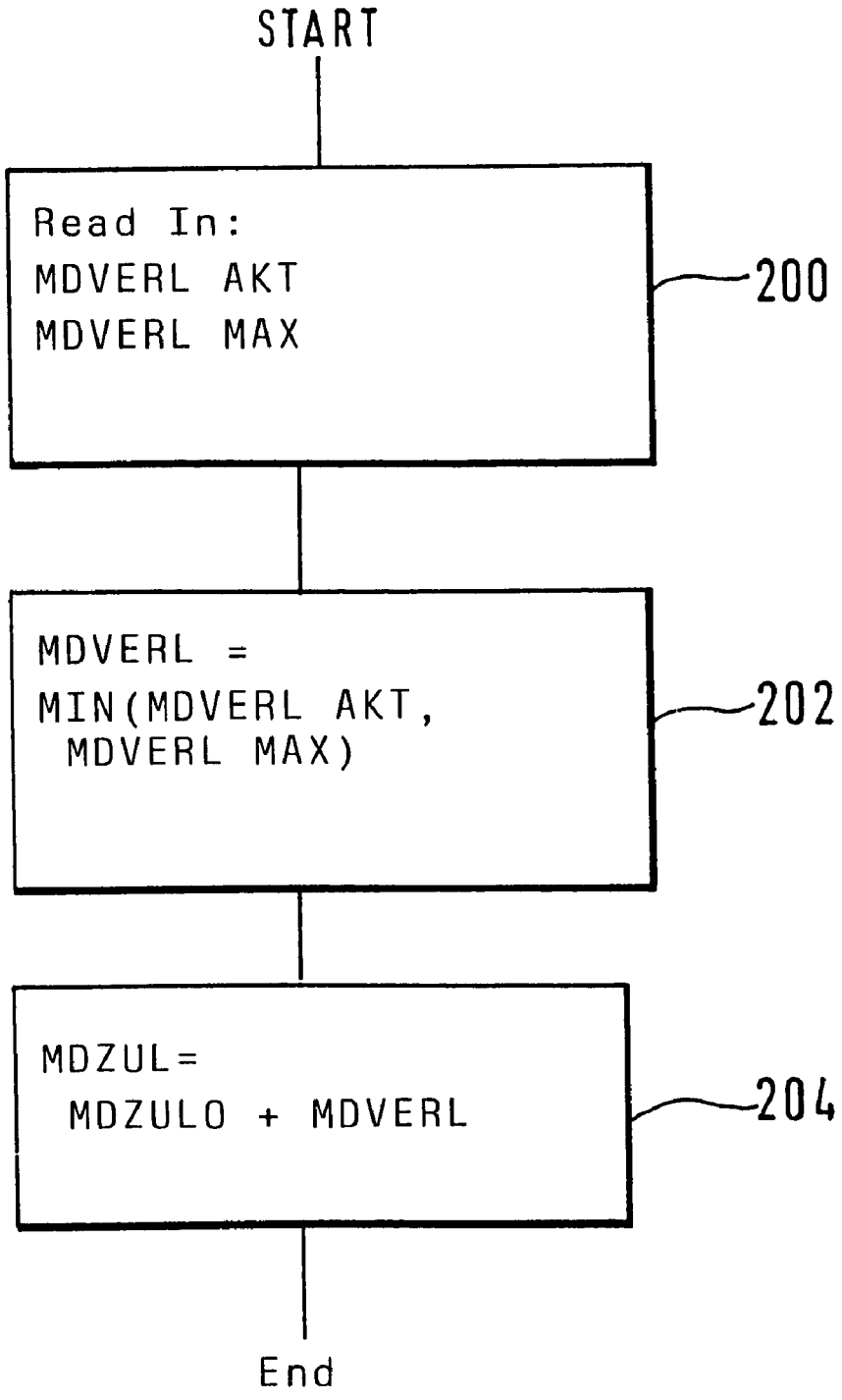
Figure 4:
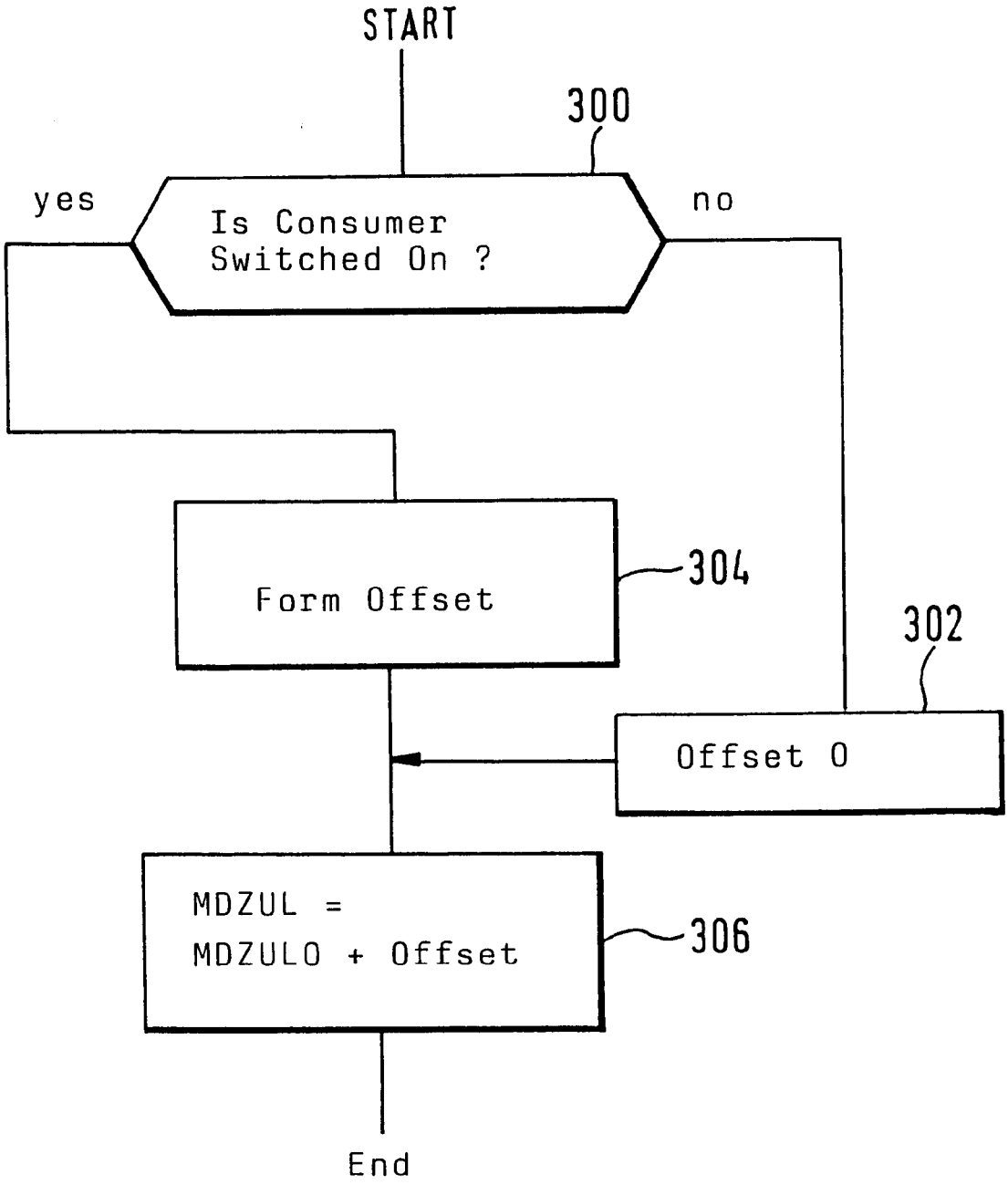

Flowcharts are shown in FIGS. 2 to 4 which illustrate the formation of the maximum permissible value for the output quantity in the above manner as a computer program.

In the program shown in FIG. 2, the signals, which indicate the activation, are compared to each other with respect to plausibility. After the start of the subprogram at pregiven time points, the two signals (1st signal, 2nd signal), which indicate the activation, are read in in a first step 100. With respect to a climate control compressor, these signals are the switch-on signal B_KO and the signal LASTKO, which represents the load; with respect to a torque converter, these signals are the driving stage signal B_FS and the consumer torque MDWAN of the converter; with reference to a catalytic converter heating function, these signals are the catalytic converter heating function B_KHZ and the data that the desired value NDES has exceeded a pregiven limit value NDES0.

For other ancillary functions and consumers (such as a power steering or, for example, a secondary air pump, which serves to improve postcombustion of the uncombusted exhaust-gas components during warm running), other quantities are provided. For example, with a power steering, a consumer torque value and a switching signal are formed when the steering wheel is turned. In the next step 102, a check is made for each component as to whether both signals are plausible to each other, that is, whether both signals indicate an activation or both signals indicate a deactivation of the component. If this is the case, then, in step 104, the consideration of the particular requirement value in the permissible value for the output quantity is permitted, preferably, for the permissible torque value. If both signals are not plausible relative to each other, then, in accordance with step 106, in the context of an emergency operation, the possibly computed requirement value is not computed in the permissible value. The program is ended in accordance with steps 104 and/or 106 and is repeated at the next time point.

The consideration of the requirement values in the permissible value to be undertaken when the signals are plausible in accordance with step 104, is shown in FIG. 3 in accordance with the first embodiment. This program too is run through at pregiven time points as long as the activation signals are plausible to each other. If there is no plausibility of these signals recognized for a component, then the requirement value for this component is not included in the computation. If all components are affected, the program is not initiated and the maximum permissible value is formed without requirement values. In the step 200, the sum of the actual consumption torques MDVERLAKT of the components recognized as active is formed and the corresponding sum of the rpm-dependent maximum values MDVERLMAX is read in. The actual loss torque results from the sum of the loss torques of the components and their adaptation factors as well as, if required, of the loss torques of the drag torque of the engine which is formed on the basis of rpm and engine temperature. Correspondingly, the maximum loss torque results on the basis of the sum of the maximum values which are assigned to the particular component as well as from the sum of an rpm-dependent part for each component. In the next step 202, the requirement value MDVERL, which is to be considered, is formed as the minimum value from the actual value and the maximum value. According to step 204, the maximum permissible torque MDZUL is then superposed on the maximum torque value MDZUL0, which is determined on the basis of the driver command. This superposition can, for example, take place via addition. Thereafter, the program is ended and is run through anew at the next time point.

The above shown second embodiment for considering the requirement values in the maximum permissible value is shown in FIG. 4. This program too is run through at pregiven time points. After the start of the subprogram, a check is made in the first step 300 based on the activation signals as to whether the component under consideration is switched on. If this is not the case, then the offset is set to the value 0 (step 302). If the component is active, then according to step 304, the offset is formed as a fixed value via an rpm-dependent characteristic line or from a characteristic field as a function of the transmitted load by the component and the rpm. In step 306, the offset is then superposed (for example, by addition) on the torque MDZUL0 for forming the maximum permissible value MDZUL. The permissible torque MDZUL0 is formed on the basis of the driver command. Thereafter, the program is ended and is run through anew at the next time point. For each selected component, a corresponding program is present. Preferably, the sum of the offset values is formed and is superposed on the permissible torque.

The above way of determining the maximum permissible value of the output quantity takes place especially in combination with the formation of this maximum value in the second level, the monitoring level; in other embodiments, additionally or as an alternative, the determination of the maximum permissible value of the output quantity takes place in the first program level wherein likewise a maximum value is formed to limit the desired value for the drive unit control.

The described procedure is applicable to spark-injection internal combustion engines, diesel engines or to alternative drive concepts such as electric motors.

The above consumers and ancillary functions can be utilized in any desired combination or individually.

It is understood that the foregoing description is that of the preferred embodiments of the invention and that various changes and modifications may be made thereto without departing from the spirit and scope of the invention as defined in the appended claims.

What is claimed is:

1. An arrangement for controlling a drive unit of a vehicle, the drive unit having an output quantity, the arrangement comprising:

a control unit for outputting at least one actuating quantity via at least one output line for controlling said drive unit in the sense of an input quantity dependent upon a driver command;

said control unit including at least one computer which increases said output quantity independently of the driver command when at least one consumer or at least one ancillary function is activated;

said computer functioning to provide a maximum permissible value of said output quantity and operating on said output quantity in a reducing direction when said output quantity exceeds said maximum permissible value;

means for supplying to said computer information as to the activation state of said at least one consumer or of said ancillary function on the basis of two redundant quantities; and, said computer functioning to increase said maximum permissible value only when, from the supplied information, an actual activation of the consumer or the ancillary function has been determined.

2. A method of controlling a drive unit of a vehicle, the method comprising the steps of:

forming a desired value for an output quantity of said drive unit at least on the basis of a driver command;

controlling said drive unit to adjust said desired value;

pregiving a maximum permissible value for said output quantity and reducing said output quantity when said output quantity exceeds said maximum permissible value;

increasing said output quantity when at least one consumer or an ancillary function is activated independently of said driver command;

increasing said maximum permissible value when said consumer or said ancillary function is actually switched on; and, deriving the actual switch-on on the basis of at least two quantities which represent the activation status of said consumer or ancillary function.

3. The method of claim 2, wherein said consumer is one of the following: a climate control compressor, a torque converter of an automatic transmission, a power steering unit or a secondary air pump.

4. The method of claim 2, wherein said ancillary function is a catalytic converter heating function.

5. The method of claim 2, wherein: with respect to a climate control compressor, the switch-on signal and a load information are present as activation status signals; and, with respect to a torque converter, a gear selection switching signal and a loss torque value of said torque converter are present as activation status signals.

6. The method of claim 2, wherein: with respect to the ancillary function of a catalytic converter heating, the activation status is derived from a datum which defines an overshoot of an rpm threshold by the idle desired rpm as well as a mark which indicates that the function is active.

7. The method of claim 2, wherein a current requirement value is formed on the output quantity for the active consumer or ancillary function; the maximum value for the active consumer or ancillary function is pregiven; and, the maximum permissible value is increased by the value which corresponds to the minimum of the instantaneous requirement value and the maximum requirement value.

8. The method of claim 2, wherein the maximum permissible value is increased by an offset value which is pregiven when the particular consumer or ancillary function is actually active.

9. The method of claim 8, wherein: the offset value for each consumer and/or ancillary function is pregiven as a fixed value; and, said offset value is read out from a characteristic line as a function of rpm or from a characteristic field as a function of rpm and the load caused by the consumer or ancillary function.

10. The method of claim 2, wherein said output quantity is the torque of said drive unit.

11. The method of claim 2, wherein: with the determination of the instantaneous requirement value of a consumer and/or an ancillary function, the adaptation factor thereof and/or the drag torque of the engine is included.

* * * * *